United States Patent [19]

Otobe et al.

[11] Patent Number: 4,639,870

[45] Date of Patent: Jan. 27, 1987

[54] FUEL SUPPLY CONTROL METHOD FOR INTERNAL COMBUSTION ENGINES, WITH ADAPTABILITY TO VARIOUS ENGINES AND CONTROLS THEREFOR HAVING DIFFERENT OPERATING CHARACTERISTICS

[75] Inventors: Yutaka Otobe, Shiki; Takeo Kiuchi, Asaka; Kikuo Tomozawa, Minato, all of Japan

[73] Assignees: Honda Giken Kogyo Kabushiki Kaisha; Oki Denki Giken Kogyo Kabushiki Kaisha, both of Tokyo, Japan

[21] Appl. No.: 619,788

[22] Filed: Jun. 12, 1984

[30] Foreign Application Priority Data

Jun. 15, 1983 [JP] Japan ..... 58-107550

[51] Int. Cl.[4] ..... F02D 5/02

[52] U.S. Cl. ..... 364/431.05; 364/431.04; 123/480

[58] Field of Search ..... 364/431.07, 431.05, 364/431.04, 431.03; 123/480, 492, 493, 417

[56] References Cited

U.S. PATENT DOCUMENTS

| | | | |
|---|---|---|---|
| 4,309,759 | 1/1982 | Tokuda et al. | 364/431.05 |
| 4,365,299 | 12/1982 | Kondo et al. | 123/480 |
| 4,376,428 | 3/1983 | Hata et al. | 364/431.04 |
| 4,440,131 | 4/1984 | Felger et al. | 123/480 |
| 4,459,962 | 7/1984 | Yamato et al. | 123/493 |

*Primary Examiner*—Parshotam S. Lall
*Attorney, Agent, or Firm*—Lyon & Lyon

[57] ABSTRACT

A fuel supply control control method for an internal combustion engine, which is adapted to determine a quantity of fuel for supply to the engine by multiplying a basic value of the quantity of fuel determined as a function of at least one operating parameter of the engine, by correction coefficients dependent upon operating conditions of the engine, and adding to the basic value correction variables dependent upon operating conditions of the engine, and to supply the determined quantity of fuel to the engine. Values of predetermined one of the above correction coefficients and predetermined one of the above correction variables are determined, which correspond to a set desired value of output voltage of a single voltage creating means. The basic value of the quantity of fuel is corrected by the determined values of the predetermined one correction coefficient and the predetermined one correction variable through multiplication and addition, respectively, to determine the quantity of fuel. Preferably, a plurality of pairs of a value of the predetermined one correction coefficient and a value of the predetermined one correction variable are stored beforehand, and one pair is selected from the plurality of pairs, which corresponds to the set desired value of output voltage of the voltage creating means. Further, preferably, in adjacent ones of the plurality of pairs, either the predetermined one correction coefficient of the predetermined one correction variable is set at the same value.

3 Claims, 8 Drawing Figures

FIG. 3

| TPRO / KPRO | TPRO1 (−0.2) | TPRO2 (−0.1) | TPRO3 (0) | TPRO4 (+0.1) | TPRO5 (+0.2) |
|---|---|---|---|---|---|
| KPRO1 (0.96) | VPRO 1−1 | VPRO 1−2 | VPRO 1−3 | VPRO 1−4 | VPRO 1−5 |
| KPRO2 (0.98) | VPRO 2−1 | VPRO 2−2 | VPRO 2−3 | VPRO 2−4 | VPRO 2−5 |
| KPRO3 (1.00) | VPRO 3−1 | VPRO 3−2 | VPRO 3−3 | VPRO 3−4 | VPRO 3−5 |
| KPRO4 (1.02) | VPRO 4−1 | VPRO 4−2 | VPRO 4−3 | VPRO 4−4 | VPRO 4−5 |
| KPRO5 (1.04) | VPRO 5−1 | VPRO 5−2 | VPRO 5−3 | VPRO 5−4 | VPRO 5−5 |

| $V_{PROX}$ | 0 | | | | | | | | | | | | | | 2.5 | | | | | | | | | | | | 5 |
|---|---|---|---|---|---|---|---|---|---|---|---|---|---|---|---|---|---|---|---|---|---|---|---|---|---|---|---|
| $V_{PRO}$ | 5-5 | 5-4 | 5-3 | 5-2 | 5-1 | 4-1 | 4-2 | 4-3 | 4-4 | 4-5 | 3-5 | 3-4 | 3-3 | 3-2 | 3-1 | 2-1 | 2-2 | 2-3 | 2-4 | 2-5 | 1-5 | 1-4 | 1-3 | 1-2 | 1-1 |
| $K_{PRO}$ | 1.04 | 1.04 | 1.04 | 1.04 | 1.04 | 1.02 | 1.02 | 1.02 | 1.02 | 1.02 | 1.00 | 1.00 | 1.00 | 1.00 | 1.00 | 0.98 | 0.98 | 0.98 | 0.98 | 0.98 | 0.96 | 0.96 | 0.96 | 0.96 | 0.96 |
| $T_{PRO}$ | +0.2 | +0.1 | 0 | -0.1 | -0.2 | -0.2 | -0.1 | 0 | +0.1 | +0.2 | +0.2 | +0.1 | 0 | -0.1 | -0.2 | -0.2 | -0.1 | 0 | +0.1 | +0.2 | +0.2 | +0.1 | 0 | -0.1 | -0.2 |

FUEL SUPPLY CONTROL METHOD FOR INTERNAL COMBUSTION ENGINES, WITH ADAPTABILITY TO VARIOUS ENGINES AND CONTROLS THEREFOR HAVING DIFFERENT OPERATING CHARACTERISTICS

BACKGROUND OF THE INVENTION

This invention relates to a fuel supply control method for internal combustion engines, and more particularly to a method of this kind which can adapt a fuel supply control system employing the method to a variety of engines and controls therefor having different operating characteristics.

A fuel supply control system adapted for use with an internal combustion engine, particularly a gasoline engine is widely known, which is adapted to determine the fuel injection period of a fuel injection device for control of the fuel injection quantity, i.e. the air/fuel ratio of an air/fuel mixture being supplied to the engine, by first determining a basic value of the above valve opening period as a function of engine rpm and intake pipe absolute pressure and then adding to and/or multiplying same by constants and/or coefficients being functions of engine rpm, intake pipe absolute pressure, engine temperature, throttle valve opening, exhaust gas ingredient concentration (oxygen concentration), etc., by electronic computing means.

According to this proposed fuel control system, while the engine is operating in a normal operating condition, the air/fuel ratio is controlled in feedback mode such that the valve opening period of the fuel injection device is controlled by varying the value of a coefficient in response to the output from an exhaust gas ingredient concentration detecting means which is arranged in the exhaust system of the engine, so as to attain a theoretical air/fuel ratio or a value close thereto (closed loop control), whereas while the engine is operating in one of particular operating conditions (e.g. an idling region, a mixture-leaning region, a wide-open-throttle region, and a fuel-cut effecting region), the air/fuel ratio is controlled in open loop mode by the use of a mean value of values of the above coefficient applied during the preceding feedback control, together with an exclusive coefficient corresponding to the kind of operating region in which the engine is then operating, thereby preventing any deviation of the air fuel ratio from a desired air/fuel ratio, and also achieving required air/fuel ratios best suited for the respective particular operating conditions, to thus reduce the fuel consumption as well as improve the driveability of the engine.

During the above open loop control, it is desirable that the air/fuel ratio should be accurately controlled to the predetermined air/fuel ratios best suited for the respective particular operating regions, by properly applying the respective exclusive coefficients and the mean value of the first-mentioned coefficient. However, there can occur variations in operating characteristics or performance between engines in different production lots, which can result in deviation of the actual air/fuel ratio from the predetermined ones. To eliminate such deviation, it is necessary to change or rewrite contents in a memory (e.g. a read-only memory) which is provided within an electronic control system applied, and stores various correction coefficients, correction variables, etc. required for the fuel supply control.

However, if the memory is a type which cannot be changed or rewritten in stored content, such as a mask ROM, the ROM per se has to be replaced with another one, and it is also necessary to add a change to the mask pattern used for manufacture of the mask ROM, which takes two or three months to have delivery of the new ROM and also requires a large cost.

Further, the deviation of the air fuel ratio from a desired air/fuel ratio can also be due to variations in the performance of various engine operating condition sensors and a system for controlling or driving the fuel injection device, etc. and/or due to aging changes in the performance of the sensors and the system. To adjust the sensors and the system for elimination of such deviation also takes a great deal of time and cost.

SUMMARY OF THE INVENTION

It is the object of the invention to provide a fuel supply control method for internal combustion engines, which permits adjusting in a simple manner the air/fuel ratio for elimination of deviation thereof from desired values so as to adapt itself to a wide variety of engines and controls therefor having different operating characteristics and performance, at the time of delivery of the engines from the plant or at the time of maintenance operation, thereby enabling to largely curtail the cost and time for adjustment of the air/fuel ratio.

The present invention provides a fuel supply control method for an internal combustion engine, which is adapted to determine a quantity of fuel for supply to the engine by multiplying a basic value of the quantity of fuel determined as a function of at least one operating parameter of the engine, by correction coefficients dependent upon operating conditions of the engine, and adding to the basic value correction variables dependent upon operating conditions of the engine, and to supply the determined quantity of fuel to the engine.

The method according to the invention is characterized by the following steps: (1) adjusting a single voltage creating means to set an output voltage therefrom to a desired value, predetermined one of the above correction coefficients and predetermined one of the above correction variables having values thereof set as functions of the output voltage from the voltage creating means; (2) determining a value of the predetermined one correction coefficient and a value of the predetermined one correction variable corresponding to the set desired value of output voltage of the voltage creating means; and (3) multiplying the basic value of the quantity of fuel by the determined value of the predetermined one correction coefficient together with the other correction coefficients, and adding to the basic value of the quantity of fuel the determined value of the predetermined one correction variable together with the other correction variables, to determine the quantity of fuel.

Preferably, the method according to the invention includes the step of storing beforehand a plurality of pairs of a value of the predetermined one correction coefficient and a value of the predetermined one correction variable, and wherein the above step (2) comprises selecting one pair from said plurality of pairs, which corresponds to the set desired value of output voltage of the voltage creating means obtained in the above step (1).

Further, preferably, in adjacent ones of the plurality of pairs, either the predetermined one correction coefficient or the predetermined one correction variable is set at the same value.

The above and other objects, features, and advantages of the invention will be more apparent from the ensuing detailed description taken in conjunction with the accompanying drawings.

BRIEF DESCRIPTION OF THE DRAWINGS

FIG. 3 is a view showing a table of correction coefficient KPRO and correction variable TPRO, and set voltage value VPRO, according to the method of the invention;

DETAILED DESCRIPTION

Figure 1:
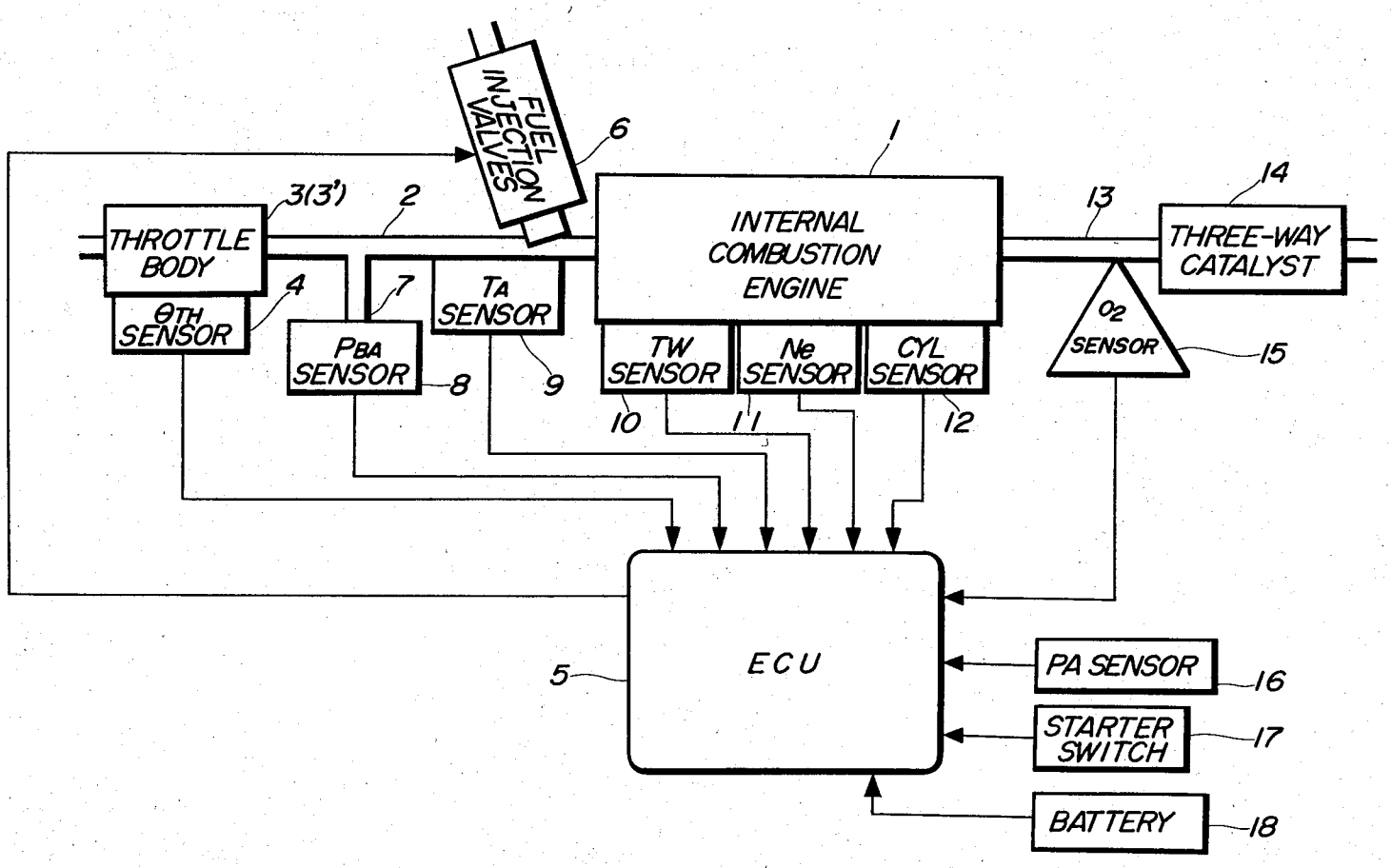
FIG. 1 is a block diagram of the whole arrangement of a fuel supply control system for internal combustion engines, to which is applied the method according to the present invention.

The present invention will now be described in detail with reference to the drawings. Referring first to FIG. 1, there is illustrated the whole arrangement of a fuel supply control system for internal combustion engines, to which is applied the method according to the invention. Reference numeral 1 designates an internal combustion engine which may be a four-cylinder type, for instance. An intake pipe 2 is connected to the engine 1, in which is arranged a throttle body 3 accommodating a throttle valve 3', which in turn is coupled to a throttle valve opening ($\theta$th) sensor 4 for detecting its valve opening and converting same into an electrical signal which is supplied to an electronic control unit (hereinafter called "the ECU") 5.

Fuel injection valves 6 forming a fuel injection device are arranged in the intake pipe 2 at locations between the engine 1 and the throttle valve 3', which correspond in number to the engine cylinders and are each arranged at a location slightly upstream of an intake valve, not shown, of a corresponding engine cylinder. These injection valves are connected to a fuel pump, not shown, and also electrically connected to the ECU 5 in a manner having their valve opening periods or fuel injection quantities controlled by signals supplied from the ECU 5.

On the other hand, an absolute pressure sensor (PBA) sensor 8 communicates through a conduit 7 with the interior of the intake pipe 2 at a location downstream of the throttle valve 3'. The absolute pressure sensor 8 is adapted to detect absolute pressure in the intake pipe 2 and applies an electrical signal indicative of detected absolute pressure to the ECU 5. An intake air temperature (TA) sensor 9 is arranged in the intake pipe 2 at a location downstream of the absolute pressure sensor 8 and also electrically connected to the ECU 5 for supplying same with an electrical signal indicative of detected intake air temperature.

An engine temperature (TW) sensor 10, which may be formed of a thermistor or the like, is mounted in the cylinder block of the engine 1 in a manner embedded in the peripheral wall of the cylinder block having its interior filled with cooling water, an electrical output signal of which is supplied to the ECU 5.

An engine rotational angle position (Ne) sensor 11 and a cylinder-discriminating (CYL) sensor 12 are arranged in facing relation to a camshaft, not shown, of the engine 1 or a crankshaft of same, not shown. The former 11 is adapted to generate one pulse at a particular crank angle of the engine each time the engine crankshaft rotates through 180 degrees, i.e., upon generation of each pulse of a top-dead-center position (TDC) signal, while the latter is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the cylinder block of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a detected concentration value to the ECU 5.

Further connected to the ECU 5 are a sensor 16 for detecting atmospheric pressure (PA) and a starter switch 17 for actuating the engine starter, not shown, of the engine 1, respectively, for supplying an electrical signal indicative of detected atmospheric pressure and an electrical signal indicative of its own on and off positions to the ECU 5.

Further electrically connected to the ECU 5 is a battery 18, which supplies the ECU 5 with a supply voltage for operating the ECU 5.

The ECU 5 operates in response to various engine operation parameter signals as stated above, to determine operating conditions in which the engine is operating, such as a fuel cut operating region, etc. and to calculate the fuel injection period of the fuel injection valves 6, which is given by the following equation, in accordance with the determined operating conditions of the engine and in synchronism with generation of pulses of the TDC signal:

$$TOUT = Ti \times (KTW \times KAST \times KWOT \times KLS \times KO_2 \times KPRO) + TACC \times (KTWT \times KTAST) + TAST + TPRO + TV \quad (1)$$

where Ti represents a basic value of the fuel injection period of the fuel injection valves 6, which is determined by engine rpm Ne and intake pipe absolute pressure PBA, and KTW an engine temperature-dependent correction coefficient, which has its value determined by engine cooling water temperature TW. KAST is a correction coefficient for increasing the fuel supply quantity immediately after the start of the engine and has its value determined by a subroutine, and KWOT and KLS are correction coefficients having constant values, of which KWOT is a mixture-enriching coefficient applicable at wide-open-throttle operation and KLS a mixture-leaning coefficient applicable at mixture-leaning operation, respectively. $KO_2$ represents an $O_2$ sensor output-dependent correction coefficient for correcting the air/fuel ratio of the mixture, the value of which is determined in response to the oxygen concentration in the exhaust gases during feedback control operation of the engine. This correction coefficient $KO_2$ has its value set to and held at respective predetermined values during engine operation in other or particular operating conditions wherein the feedback control is not effected.

In the equation (1), KPRO is a correction coefficient for adjusting the air/fuel ratio of the mixture to such values as to enable the engine to achieve optimum operating characteristics. This correction coefficient KPRO is applicable in particular operating regions other than the $O_2$ sensor output-responsive feedback control region and including an $O_2$ sensor-deactivated region, an idling region, a wide-open-throttle region, a predetermined low speed open-loop control region, and a predetermined high speed open-loop control region, singly or together with other correction coefficients exclusively provided for the respective particular operating regions. In these particular operating regions, usually the value of the correction coefficient KPRO is set to 1.0 or a value close thereto so as to achieve air/fuel ratios best suited for the operating regions.

In the equation (1), TACC is a fuel-increasing correction variable applicable at acceleration of the engine, the value of which is determined by a subroutine. KTWT is a correction coefficient for increasing the fuel supply quantity immediately after the start of the engine, the value of which is calculated on the basis of a value of the water temperature-dependent fuel-increasing coefficient KTW read from a table, KTAST a fuel-increasing correction coefficient applicable immediately after the start of the engine, TAST a fuel-increasing correction variable applicable immediately after the start of the engine, and TPRO a correction variable provided for the same purpose as the correction coefficient KPRO and having its value determined in a manner corresponding to a determined value of the coefficient KPRO, as hereinafter described in detail, respectively. In the equation (1), TV is a correction value for adjusting the valve opening period of the fuel injection valves 6 in response to changes in the output voltage from the battery 18, the value of which is determined from a TV table.

Incidentally, the above-mentioned correction coefficients and correction variables are applied in their respective operating regions for correction of the valve opening period. In operating regions in which they should not be applied, the correction coefficients are set to 1.0, and the correction variables to 0, respectively.

According to the invention, the correction coefficient KPRO in the multiplicative term of the equation (1) and the correction variable TPRO in the additive term thereof are set to values corresponding to the output voltage of a single voltage-creating means, hereinafter referred to, so as to achieve air/fuel ratios optimal to operating conditions of the engine.

The ECU 5 operates on the value of the fuel injection period TOUT determined as above to supply corresponding driving signals to the fuel injection valves 6.

Figure 2:
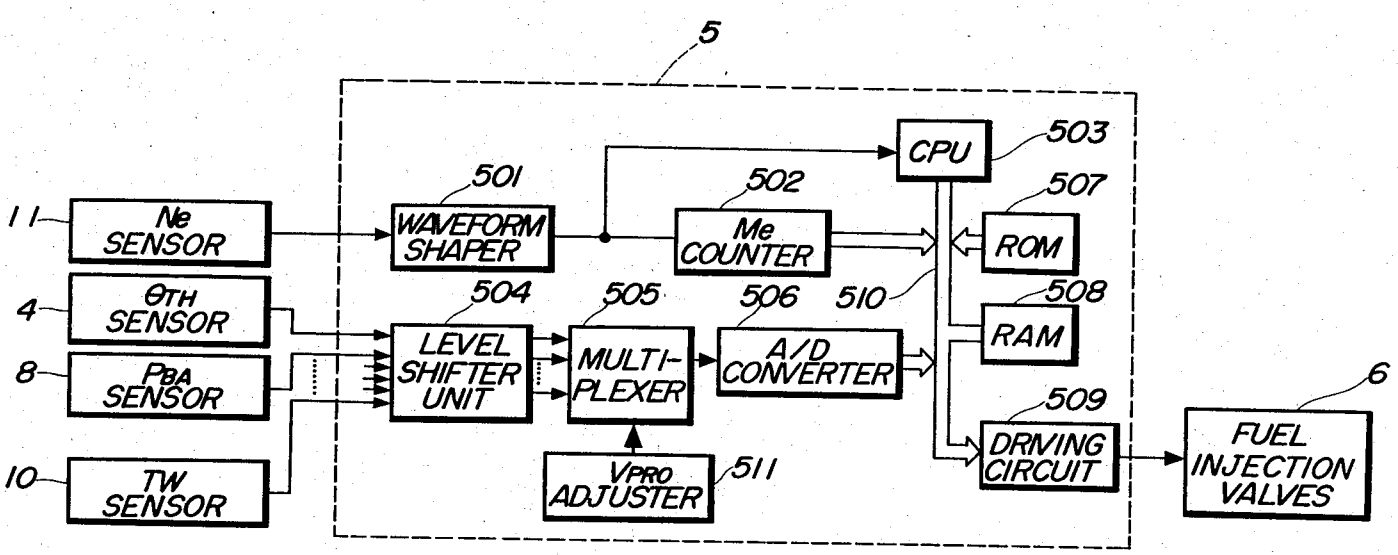
FIG. 2 is a circuit diagram of the interior construction of an electronic control unit appearing in FIG. 1.

FIG. 2 shows a circuit configuration within the ECU 5 in FIG. 1. An output signal from the engine rotational angle position (Ne) sensor 11 in FIG. 1 is applied to a waveform shaper 501, wherein it has its pulse waveform shaped, and supplied to a central processing unit (hereinafter called "the CPU") 503, as the TDC signal, as well as to an Me value counter 502. The Me value counter 502 counts the interval of time between a preceding pulse of the TDC signal generated at a predetermined crank angle of the engine and a present pulse of the same signal generated at the same crank angle, inputted thereto from the engine rotational angle position (Ne) sensor 11, and therefore its counted value Me corresponds to the reciprocal of the actual engine rpm Ne. The Me value counter 502 supplies the counted value Me to the CPU 503 via a data bus 510.

The respective output signals from the throttle valve opening ($\theta$th) sensor 4, the intake pipe absolute pressure (PBA) sensor 8, the engine coolant temperature (TW) sensor 10, etc. have their voltage levels successively shifted to a predetermined voltage level by a level shifter unit 504 and applied to an analog-to-digital digital converter 506 through a multiplexer 505. Connected to the multiplexer 505 is a VPRO value adjuster 511 which supplies the analog-to-digital converter 506 through the multiplexer 505 with an adjusted voltage VPRO determining the value of the correction coefficient KPRO and the value of the correction variable TPRO which are applied during engine operation in certain particular operating regions, as hereinafter described. This VPRO value adjuster 511 may comprise, for example, a variable voltage supply circuit formed of voltage dividing resistances or the like and preferably connected to a constant voltage-regulator circuit, not shown. The analog-to-digital converter 506 successively converts into digital signals analog output voltages from the aforementioned various sensors, the VPRO value adjuster 511, and the resulting digital signals are supplied to the CPU 503 via the data bus 510.

Further connected to the CPU 503 via the data bus 510 are a read-only memory (hereinafter called "the ROM") 507, a random access memory (hereinafter called "the RAM") 508 and a driving circuit 509. The RAM 508 temporarily stores various calculated values from the CPU 503, while the ROM 507 stores a control program executed within the CPU 503, a map of a basic fuel injection period Ti for the fuel injection valves 6, which have its stored values read in dependence on intake pipe absolute pressure and engine rpm, correction coefficient maps, etc. The CPU 503 executes the control program stored in the ROM 507 to calculate the fuel injection period TOUT for the fuel injection valves 6 in response to the various engine operating parameter signals and the parameter signals for correction of the fuel injection period, and supplies the calculated value of fuel injection period to the driving circuit 509 through the data bus 510. The driving circuit 509 supplies driving signals corresponding to the above calculated TOUT value to the fuel injection valves 6 to drive same.

FIG. 3 shows a table of the correction coefficient KPRO and the correction variable TPRO, and set output voltage VPRO from the VPRO value adjuster 511, for determining the two first-mentioned values from the last-mentioned value, according to the method of the invention. As shown in (a) of FIG. 4, the set voltage value VPROX is divided into 25 steps ranging from 0 volt to 5 volts, which can be provided by respective different combinations of the voltage dividing resistances of the VPRO value adjuster 511, and to each of which corresponds an address code of the value VPRO. In the table of FIG. 3, as the correction coefficient KPRO there are provided five predetermined values KPRO1–KPRO5, while as the correction variables TPRO there are provided five predetermined values TPRO1–TPR05. The values KPRO1–KPR05 of the correction coefficient KPRO range from 0.96 to 1.04 with a difference of 0.02 between adjacent ones thereof, while the values TPRO1–TPRO5 of the correction variable TPRO range from −0.2 ms to +0.2 ms with a different 0.1 ms between adjacent ones thereof. The correction coefficient KPRO varies from one of the predetermined values to its adjacent value each time the VPRO value varies by five steps, while the correction variable TPRO varies from one of the predetermined values to its adjacent value each time the VPRO varies by one step. The ratio of variation between the correction coefficient KPRO and the correction variable TPRO with respect to the VPRO value may be set in a manner reverse to that just mentioned above.

Figure 4:
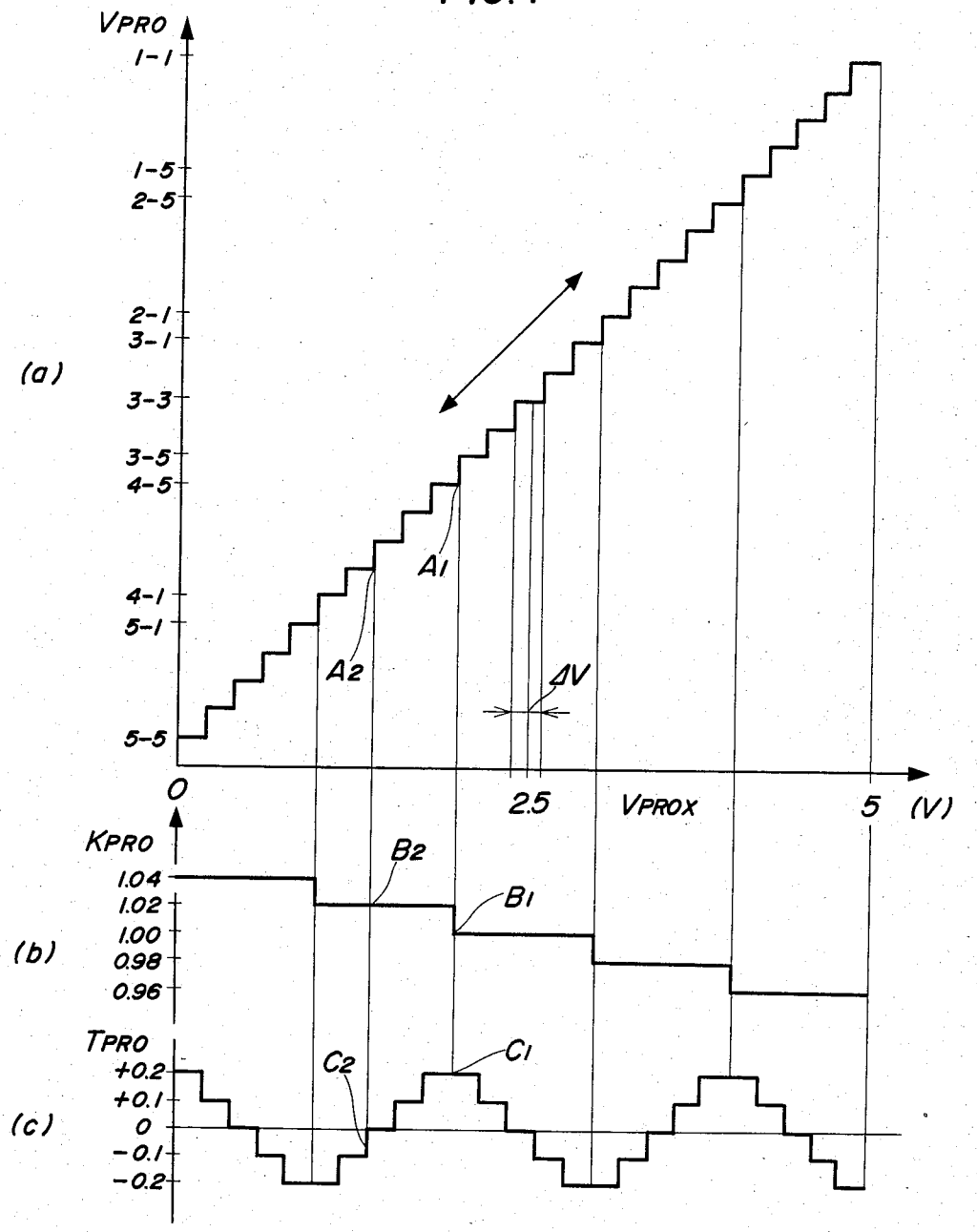
FIGS. 4*a–c* are a graph showing the relationship between the values KPRO, TPRO, and VPRO in the table of FIG. 3.
Figures 5, 6:
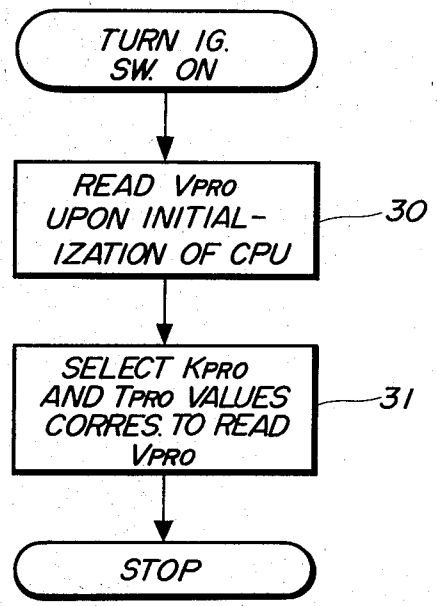
FIG. 5 is a view showing an example of the table of FIG. 3 with exemplary values of VPRO, KPRO, and TPRO.
FIG. 6 is a flowchart of a manner of executing the method of the invention.

The table of FIG. 3 is set such that the VPRO value has its median value 3—3 corresponding to the median value of 2.5 volts of the set voltage VPROX, and a change of the set voltage VPROX by one step (=0.2 volt) causes a corresponding change only in either the KPRO value or the TPRO value (that is, the two values do not change at the same time), as will be understood from the setting of the KPRO value and the TPRO value in (b) and (c) of FIG. 4. FIG. 5 shows a tabulated form of the relationship between values VPROX, VPRO, KPRO, and TPRO in accordance with the table of FIG. 4. The setting of FIGS. 4 and 5 prevents that a slight change in the adjusted set voltage value VPROX will cause large changes in the values KPRO and TPRO.

Assuming, for instance, that the set voltage value VPROX falls in the vicinity of the point A1 in (a) of FIG. 4, a slight change in the set voltage value VPROX will cause the value KPRO to change to either 1.02 or to 1.00 along the line B1 in (b) of FIG. 4, but the value TPRO will remain unchanged at +0.2 on the level C1 in (c) of FIG. 4 even with such slight change in the value VPROX. As a result, the amount of change of the TOUT value can be kept at a small value corresponding to the amount of change of 0.02 of the value of the correction coefficient KPRO.

Supposing that the set voltage value VPROX changes across the point A2 in (a) of FIG. 4, the correction coefficient KPRO will continue to assume the value of 1.02 on the level B2 in (b) of FIG. 4, while the correction variable TPRO will change to either 0 or −0.1 along the line C2 in (c) of FIG. 4. Thus, the resulting amount of change of the TOUT value can be kept at a small value corresponding to the amount of change of 0.1 of the correction variable TPRO.

As stated above, according to the illustrated setting, a slight amount of error in adjusting the set voltage value VPROX will never cause a large change in the TOUT value. Further, the set voltage value VPROX is provided with predetermined tolerances ΔV (=0.2 volt), so as to avoid deviation of the KPRO value and/or the TPRO value from a set value thereof once it has been set.

The correction coefficient KPRO and the correction variable TPRO are set to optimum values by adjusting the set voltage value VPROX of the VPRO value adjuster 511 in FIG. 2, at assemblage for incorporating a fuel supply control system employing the method of the invention into an engine, at periodic maintenance operation, etc.

By adjusting the set voltage value VPROX of the VPRO value adjuster 511 so as to select the correction coefficient KRPO of the multiplicative term and the correction variable TPRO of the additive term at respective suitable values, it is possible to cope with all possible cases in which the air/fuel ratio of the mixture becomes deviated from desired values.

FIG. 6 shows an exemplary manner of executing the method of the invention.

When the ignition switch of the engine is turned on, the CPU 5 in FIG. 2 is initialized, and at the same time the set VPRO value is read into the CPU 503, at the step 30. Values of the correction coefficient KPRO and the correction variable TPRO are read from the ROM 507 in FIG. 2, which correspond to the set VPRO value, at the step 31. The CPU 5 applies these read values of the coefficient KPRO and the variable TPRO to the equation (1) to thereby calculate the fuel injection period TOUT.

What is claimed is:

1. A fuel supply control method for an internal combustion engine, said method being adapted to determine a quantity of fuel for supply to said engine by multiplying a basic value of said quantity of fuel determined as a function of at least one operating parameter of said engine, by correction coefficients dependent upon operating conditions of said engine, and adding to said basic value correction variables dependent upon operating conditions of said engine, and to supply the determined quantity of fuel to said engine, wherein a single voltage creating means is adjusted to set an output voltage therefrom to a desired value, and a value of a predetermined one of said correction coefficients and a value of a predetermined one of said correction variables are determined which correspond to said set desired value of output voltage of said single voltage creating means, the method being characterized by comprising the steps of:

(1) adjusting a single voltage creating means to set an output voltage therefrom to a desired value, a predetermined one of said correction coefficients having a value thereof set as a function of said output voltage from said voltage creating means, and a predetermined one of said correction variables having a value thereof set as a function of said output voltage from said voltage creating means, wherein said predetermined one correction coefficient and said predetermined one correction variable are in a predetermined relationship with respect to output voltage from said voltage creating means;

(2) determining a value of said predetermined one correction coefficient and a value of said predetermined one correction variable at the same time, which corresponds to said set desired value of output of said voltage creating means; and (3) multiplying said basic value of said quantity of fuel by the determined value of said predetermined one correction coefficient together with the correction coefficients other than said predetermined one of said correction coefficients, and adding to said basic value of said quantity of fuel the determined value of said predetermined one correction variable together with the correction variables other than said predetermined one of said correction variables, to determine said quantity of fuel.

2. A fuel supply control method as claimed in claim 1, including the step of storing beforehand a plurality of pairs of a value of said predetermined one correction coefficient and a value of said predetermined one correction variable, and wherein said step (2) comprises selecting one pair from said plurality of pairs, which corresponds to the set desired value of output voltage of said voltage creating means obtained in said step (1).

3. A fuel supply control method as claimed in claim 2, wherein in adjacent ones of said plurality of pairs, either said predetermined one correction coefficient or said predetermined one correction variable is set at the same value.

* * * * *

UNITED STATES PATENT AND TRADEMARK OFFICE

CERTIFICATE OF CORRECTION

PATENT NO. : 4,639,870

DATED : Jan. 27, 1987

INVENTOR(S) : Yutaka Otobe et al.

It is certified that error appears in the above-identified patent and that said Letters Patent are hereby corrected as shown below:

Title page:

"Assignee" correct the name of the Assignee from "Oki Denki Giken Kogyo Kabushiki Kaisha" to --Oki Electric Industry Company Ltd.--

Signed and Sealed this

Fifth Day of April, 1988

*Attest:*

DONALD J. QUIGG

*Attesting Officer*

*Commissioner of Patents and Trademarks*